US005373590A

United States Patent [19]

Svae et al.

[11] Patent Number: 5,373,590

[45] Date of Patent: Dec. 20, 1994

[54] SPA COVER

[76] Inventors: Bjorn Svae; Melady J. Svae, 2420 - 123rd Ave. SE., both of Bellevue, Wash. 98005

[21] Appl. No.: 125,349

[22] Filed: Sep. 22, 1993

Related U.S. Application Data

[63] Continuation of Ser. No. 883,428, May 13, 1992, abandoned.

[51] Int. Cl.[5] ..... E04H 4/14

[52] U.S. Cl. ..... 4/499; 4/503; 4/498

[58] Field of Search ..... 4/499, 501, 503, 498, 4/509; 52/2.11; 220/231, 367

[56] References Cited

U.S. PATENT DOCUMENTS

| | | | |
|---|---|---|---|
| 1,434,846 | 11/1922 | Schwiesow | 137/590 |
| 2,580,555 | 1/1952 | Kroeger | 4/502 |
| 3,366,977 | 2/1968 | Koehler | 4/172 |
| 3,608,099 | 9/1971 | Wall | 4/172.12 |
| 3,747,133 | 7/1973 | Koliomichalis | 4/172.12 |
| 3,801,994 | 4/1974 | Brown | 4/172.12 |
| 4,048,678 | 9/1977 | Chillino | 4/172.12 |
| 4,109,325 | 8/1978 | Shuff | 4/172.12 |
| 4,115,878 | 9/1978 | Johnson et al. | 4/509 |
| 4,139,117 | 2/1979 | Dial | 4/499 |
| 4,236,259 | 12/1980 | Wendt | 4/498 |
| 4,246,663 | 1/1981 | Aragona et al. | 4/500 |
| 4,606,083 | 8/1986 | Kingston | 4/580 |
| 4,825,479 | 5/1989 | Bonneau | 4/499 |
| 4,847,925 | 7/1989 | Perry | 4/499 |
| 4,851,275 | 7/1989 | Yes | 4/502 |
| 4,936,349 | 6/1990 | Cowgur | 137/590 |
| 4,953,239 | 9/1990 | Gadsby | 4/499 |
| 5,022,101 | 6/1991 | Gosselin et al. | 4/498 |
| 5,068,929 | 12/1991 | Weiner | 4/498 |

FOREIGN PATENT DOCUMENTS

| | | | |
|---|---|---|---|
| 2650853 | 2/1991 | France | 4/498 |

*Primary Examiner*—Henry J. Recla
*Assistant Examiner*—Charles R. Eloshway
*Attorney, Agent, or Firm*—Christensen, O'Connor, Johnson & Kindness

[57] ABSTRACT

An airtight spa cover (11) supported by air generated by the spa pump and the spa blower (29). The cover is attached to the external periphery of the spa walls (17) and includes a skirt (29) that extends into the spa water (35), adjacent to the internal periphery of the spa walls (17). The pressure of the air trapped between the skirt (24), the surface (33) of the water, and the overlaying portion of the cover (11) is adequate to support an adult. The attachment mechanism is designed to prevent unauthorized entry when the spa cover is pressurized. The spa cover (11) includes an air ventilation pipe (49) whose lower end, initially, lies beneath the surface (33) of the spa water (35). As the pressure rises, the lower end rises above the surface of this spa water allowing trapped air to escape. The cover rises and falls until a pressure balance is achieved. The spa cover is deflated by raising a pressure release pipe (59) to allow the air trapped in a dead air space (37) to escape.

23 Claims, 6 Drawing Sheets

SPA COVER

This application is a continuation application based on prior copending application Ser. No. 07/883,428, filed on May 13, 1992, which is now abandoned.

TECHNICAL AREA

This invention is related to spas and, more particularly, to covers for covering a hot tub or spa when not in use.

BACKGROUND OF THE INVENTION

Covers currently used with more than 90 percent of all spas and hot tubs that are covered during nonuse include a closed cell foam plastic core covered with vinyl plastic cloth. Frequently aluminum channel or plywood is included to increase strength. The main advantage of present covers is the reduction in heat loss due to the good insulating properties of closed cell foam. Correctly fitted, new covers look neat and prevent debris from entering the spa.

The major disadvantage of contemporary spa covers of the type described above is the significant weight that such covers gain as a result of water absorption. More specifically, even the best closed cell foams absorb spa condensation over time. increasing the weight of a closed cell foam spa cover. The weight may double and triple in only a couple of years. Two- to three-year-old covers are commonly so heavy that the average person has difficulty lifting them. Unfortunately, the water stored in a closed cell foam spa cover cannot be purged. It is permanently retained by the foam. While lift mechanisms have been developed for assisting in the installation and removal of spa covers, such mechanisms are cumbersome and are not practical in many installations.

Another disadvantage of foam core spa covers is their propensity to crack or break when subjected to the weight of an adult standing on the center of a cover installed on a spa. This disadvantage is particularly true with respect to original equipment spa covers. i.e.. those supplied when a spa is installed. Such covers are often of low quality and cost. While replacement market spa covers are of higher quality, price quickly escalates with strength and durability, and the installation of lifting mechanisms.

Because foam core spa covers typically only fold to half their full size, storage is very difficult. The bulky nature of foam core makes foam core spa covers expensive to ship to and store by distributors. These problems prevent any manufacturer without regional manufacturing capability from becoming a national supplier.

A further disadvantage of foam core spa covers is the difficulty in locking them to a spa. Because locking a foam core spa cover is typically cumbersome and impractical, it is seldom done. This allows unauthorized people to have ready access to spas covered by foam core spa covers.

Prior attempts to overcome the foregoing disadvantages of foam core spa covers have involved rigid dome-shaped covers, flexible floating covers and flexible covers supported by air-inflated bags and the like. All of these covers have disadvantages. Rigid dome covers (see U.S. Pat. No. 4,426,663) are complex. Flexible floating covers (see U.S. Pat. No. 4,109,325) are somewhat difficult to store. More importantly, floating covers do not provide support for an adult or limit access to a spa. Flexible covers supported by air-inflated bags and the like require a separate inflation source, often do not limit access to a spa and/or are more difficult to store than desired. See U.S. Pat. Nos. 3,366,977; 3,608,099; 3,747,131; 3,801,994: 4,048,678; 4,606,083; 4,825,479; 4,847,925 and 4,953,239.

Hence, a need exists for a spa cover which is simple to use, can be folded for storage, lightweight (less than 20 lbs. for an average spa), does not increase in weight over time, supports the weight of an adult, deters unwanted entry and keeps debris out while providing good, thermal insulation. The present invention is directed to providing such a spa cover.

SUMMARY OF THE INVENTION

This invention provides an airtight spa cover supported entirely by the pressure of the air generated by the spa pump and (if present) the spa blower. The air is trapped between the spa cover and the surface of the spa water. The cover is attached to the external periphery of the spa walls and includes a skirt that extends into the spa water near the internal periphery of the spa walls. The pressure of the air trapped between the skin, the surface of the water, and the overlying portion of the cover is adequate to support an adult. The attachment mechanism is designed to prevent unauthorized entry when the cover is pressurized. The spa cover includes an air ventilation pipe whose lower end, initially, lies beneath the surface of the spa water. As the pressure rises, the lower end of the ventilation pipe rises above the spa water, allowing trapped air to escape. The cover rises and falls until the pressure balance is achieved. The spa cover is deflated by raising a pressure release pipe to allow the trapped air to escape.

In accordance with other aspects of this invention, the spa cover is attached to the spa by an attachment mechanism that cannot be readily detached when the spa cover pressure is balanced.

In accordance with further aspects of this invention, the attachment mechanism comprises pockets and rods located around the periphery of the spa cover and attachment hooks positioned around the periphery of the spa for engaging the rods.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

As will be better understood from the following description, the invention provides an airtight spa cover designed such that air trapped inside the cover can only escape through a ventilation air pipe. The ventilation air pipe is designed to prevent over inflation. A separate deflation mechanism that includes a pressure relief pipe is used to deflate the cover when removal is desired. The preferred cover material is a vinyl-coated fabric of a thickness suitable for maintaining the shape of the cover. The chosen fabric must be air impermeable and resistant to spa chemicals kept within the recommended limits set for comfortable spa use.

Figure 1:
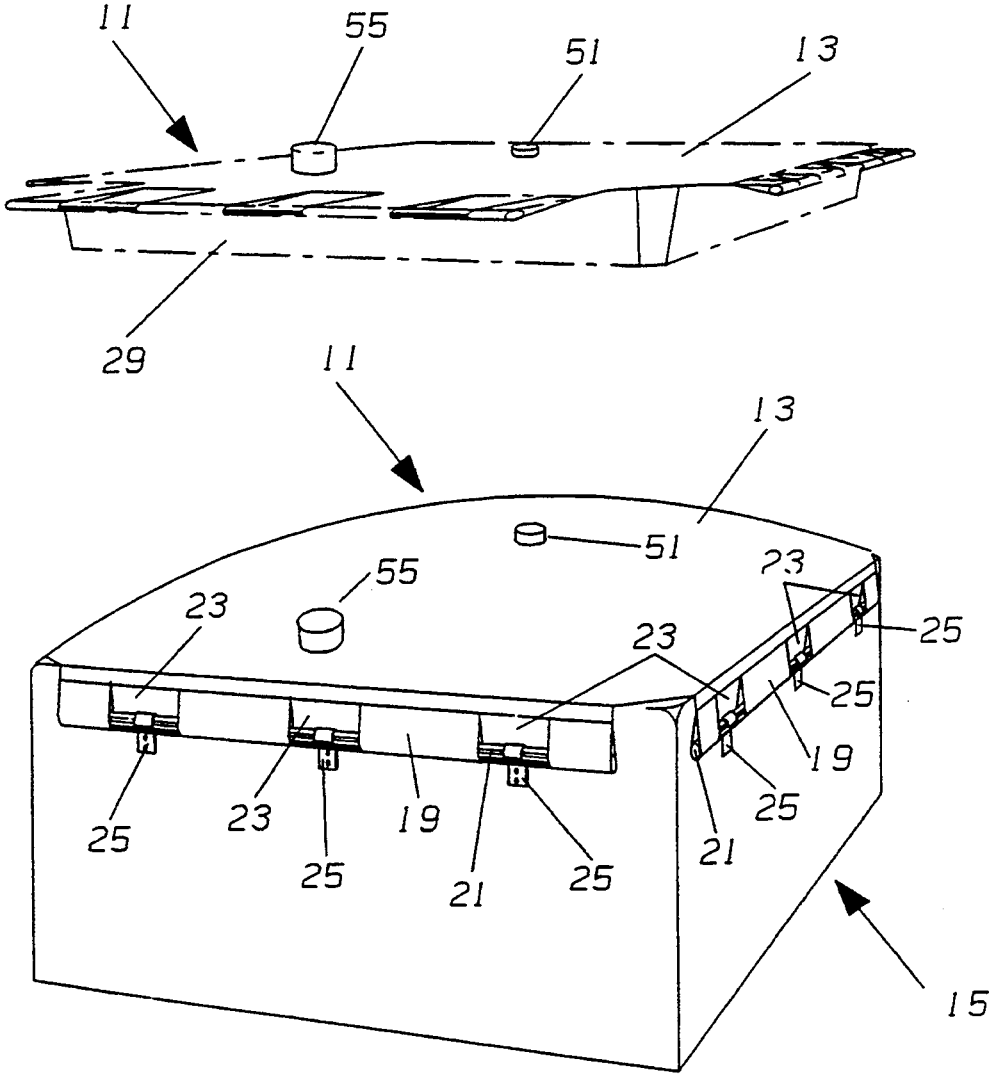
FIG. 1 is a pictorial view illustrating a spa cover (in phantom) formed in accordance with the invention suspended over a spa and the spa cover attached to a spa.
Figure 2:
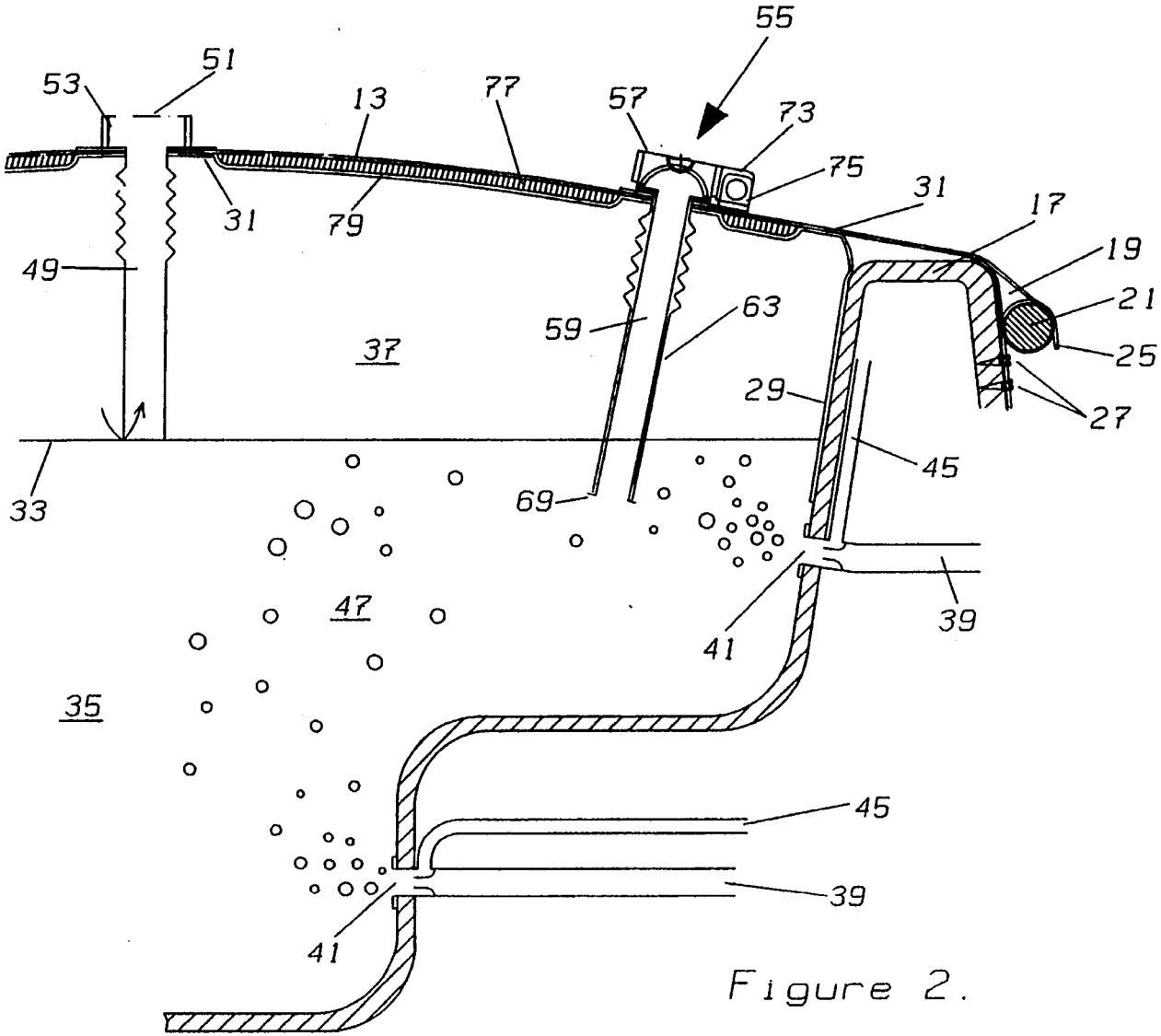
FIG. 2 is a partial cross-sectional view of a spa cover formed in accordance with the invention attached to the wall of a spa in the region where air from the spa pump and the spa blower enter the spa water.
Figure 4:
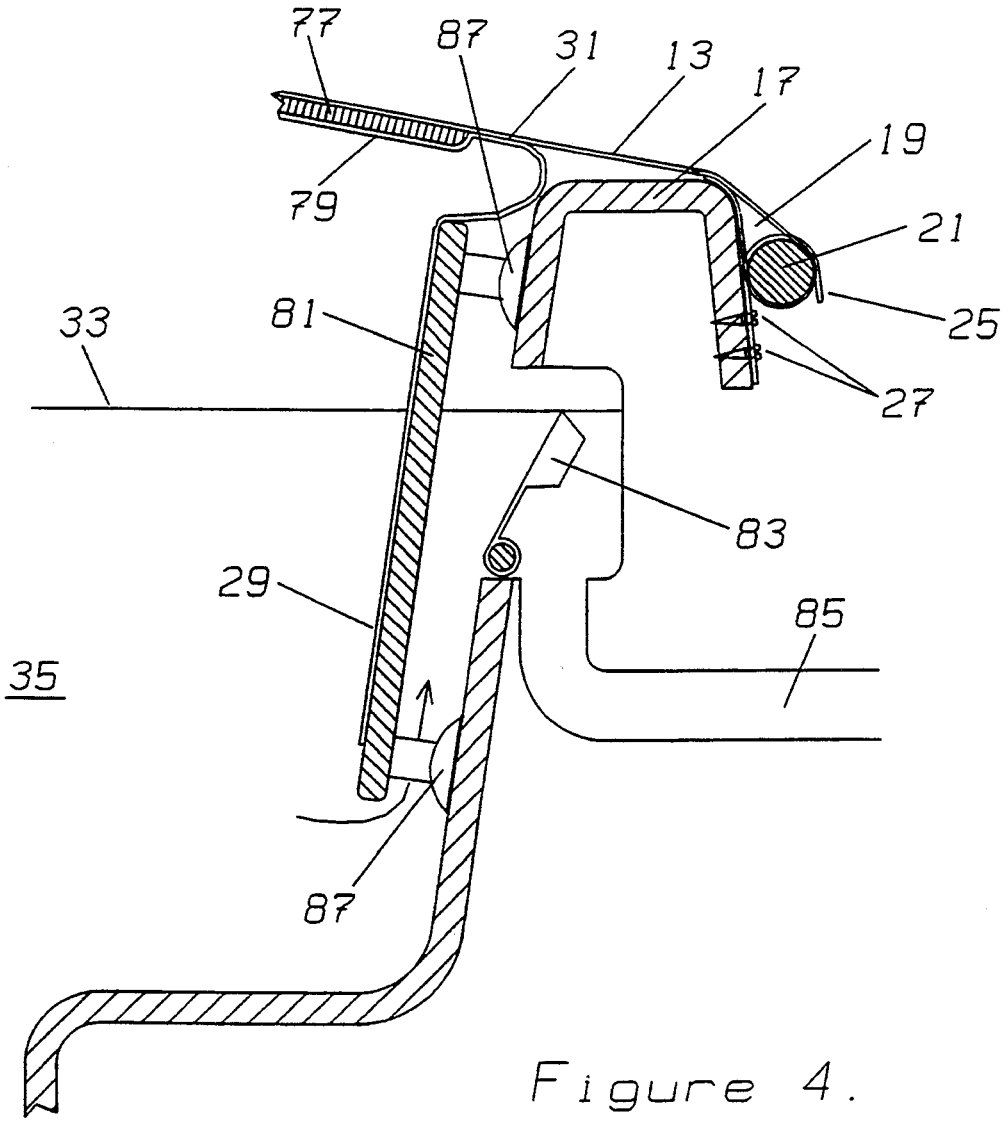
FIG. 4 is a second cross-sectional view of a spa cover formed in accordance with the invention attached to the wall of the spa in the region where the strainer and return line to the spa filter are located.

As shown in FIGS. 1, 2 and 4, a spa cover 11 formed in accordance with this invention includes an outer sheet 13 of sufficient size to cover the entire surface area of a spa 15 including the spa edges 17. Located along each edge of the outer sheet 13 of the cover 11 is a pocket 19. Each edge pocket 19 contains a rigid fastener rod 21 made from metal, fiberglass or any suitably rigid material.

Since the number of edges is a function of the size and shape of the spa to be covered, the number of fastener rods 21 and the number of pockets 19 is a function of the size and shape of the spa. As shown, a square or rectangular spa, which has four sides, has four pockets 19 and four rods 21. Preferably, each rod is made of multiple segments to facilitate folding of the cover. In this regard, while not shown, preferably the pockets are formed so as to prevent the easy removal of the rod sections. Each of the pockets 19 includes one and preferably more cutouts 23 which allow the fastener rods 21 to be slipped under hooks 25 installed on the side of the spa edges 17. The hooks 25 are inverted and attached to the edges 17 of the spa 15 by screws 27. Thus, the hooks anchor the cover 11 to the spa 15.

A vinyl skirt 29 is affixed to the inner surface of the outer sheet 13 by airtight welds 31. The skirt spans the periphery of the spa cover, approximately at the inside surface of the spa edge. The vinyl skirt 29 drapes below the surface 33 of the spa water 35 and forms an airtight seal with the water surface when the cover is placed on a spa. Preferably, the vinyl skirt 29 is located as close to the inside surface of the spa edge 17 as possible in order to form the largest possible dead air space 37 above the spa water, which optimizes the insulating properties of the cover. Preferably, the skin 29 tapers slightly inward, toward the center of the spa, because tapered skirts do not require the support of the spa edge 17 in order to form an airtight seal with the water surface 33.

In normal operation, water under pressure from the spa pump (not shown) is delivered through one or more water inlet pipes 39 to venturis 41, which cause air obtained from the air inlet pipes 45 to be injected into the water. If the spa is equipped with an air blower (not shown), a larger volume of air may be supplied by connecting one or more of the air pipes 45 to the blower. Regardless of their source, air bubbles 47 that enter the spa water 35 rise to the water surface. The air bubbles release air into the dead air space 37 defined by the outer sheet 13, the skin 29 and the surface 33 of the water 35. The released air bubbles 47 creates air pressure that inflates the spa cover. Inflation occurs without the need for external blowers, piping or plumbing, i.e., an air supply that is normally not part of spa standard equipment.

Preferably, the hooks 25 are installed on the outer surface of the spa edge 17 and the cover 11 is sized such that a slight stretch of the cover is required to move the fastener rods 21 under the hooks. The use of hooks and fastener rods facilitates installing the cover on various shaped spas, including square, rectangular, round and irregular-shaped spas because the length of the fastener rods 21 and corresponding pockets 19 can be sized to accommodate the shape of the spa. Shorter fastener rods 21 facilitate the ability to fold the cover tighter so it can be packaged in a smaller volume for shipment.

The cover 11 is properly installed by slipping the fastener rods 21 under the hooks 25. The normal operation of the spa pump or blower causes the pressure inside the dead air space 37 to increase. The increased pressure causes the outer sheet 13 of the cover 11 to rise until the lower end of a flexible air ventilation pipe 49 rises above the water surface 33. More specifically, the cover 11 includes a vertically oriented, flexible air ventilation pipe 49 that is open at both ends. The upper end of the air ventilation pipe 49 is affixed to the outer sheet 13 of the cover. When the lower end of the air ventilation pipe 49 rises above the surface 33 of the spa water 35, air from the dead air space 37 escapes to the atmosphere through the air ventilation pipe 49 and a perforated ventilation cap 51 permanently attached to a flange 53 located at the upper end of the air ventilation pipe. When the lower end of the air ventilation pipe 49 is located above the water surface 33, the cover starts to deflate, lowering the outer sheet 13 of the cover 11 until the lower end of the air ventilation pipe 49 submerges under the water surface 33, sealing the dead air space 37 from the atmosphere.

After the lower end of the air ventilation pipe 49 submerges, the pressure inside the dead air space rises and the cycle is repeated. After several cycles, the system will stabilize. Stabilization occurs when the amount of air escaping through the air ventilation pipe 49 equals the amount of air injected into the water through the venturis 41. If the spa blower or pump is shut off, the cover will remain inflated. Preferably, the cover 11 is sized such that when the cover is fully inflated, which occurs when the lower end of the air ventilation pipe 49 is barely submerged beneath the water surface 33, the cover is so tight that the fastener rods 21 cannot be pulled below the hooks 25. This manner of attachment prevents access to the spa without first deflating the spa cover in the manner described below.

Figure 3:
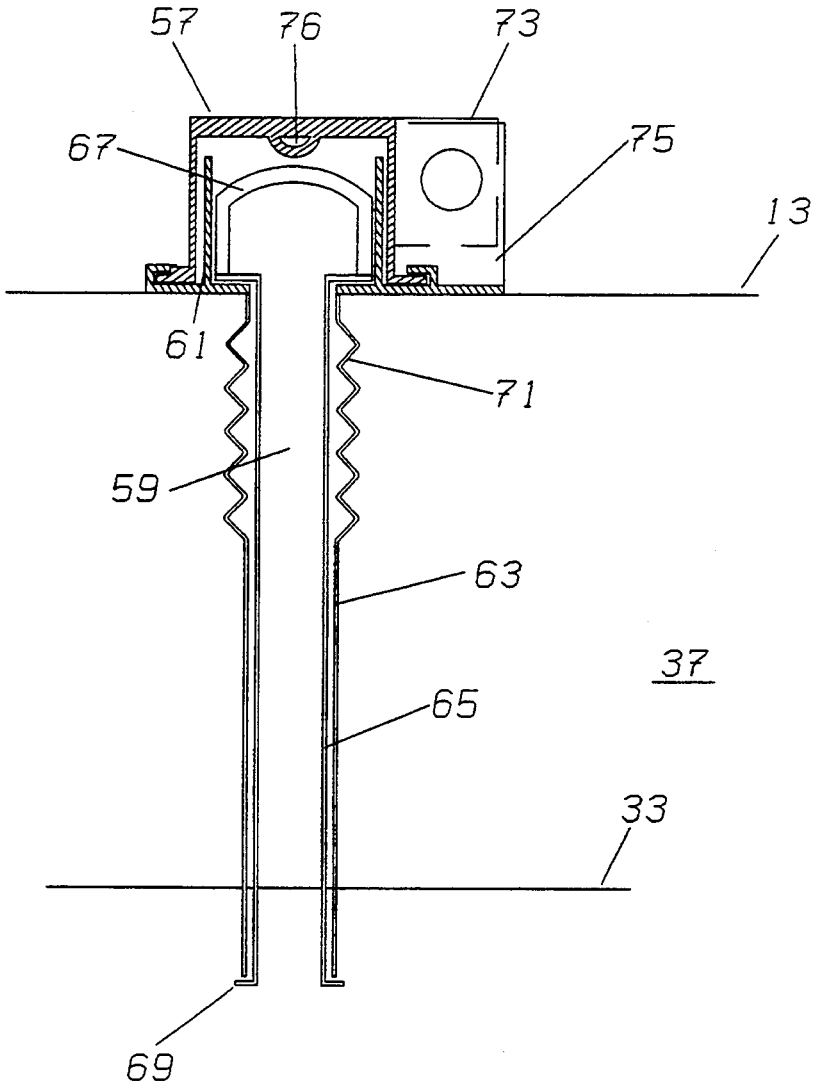
FIG. 3 is an enlarged view of the deflation mechanism illustrated in FIG. 2.

In order to remove the cover 11, it must first be deflated. As best shown in FIG. 3, deflation is accomplished by a deflation mechanism 55 that comprises a cap 57, and a pressure release pipe 59. The cap 57 is attached via a 360° turn fastener to a flange 61 attached to the outer surface of the outer sheet 13. When the cap 57 is removed, the pressure release pipe 59 is accessible. The pressure release pipe includes two tubular telescoping sections: an outer flexible section 63 and an inner solid section 65. A handle 67 is located at the upper end of the inner section 65, inside of the flange 61. A lower flange 69 extends outwardly from the lower end of the inner section 65, beneath the lower end of the outer section 63. As a result, when the handle 67 is pulled, the lower flange 69 applies a force to the lower end of the outer section. This force causes a corrugated part 71 of the outer section 63 to collapse. As a result, the outer section shortens and the lower ends of both sections are raised above the water surface 33, causing the dead air space 37 to be connected to the atmosphere via the inner section releasing the air pressure supporting the cover 11. When the pressure in the dead air space 37 equals atmospheric pressure, the fastener rods 21 may be removed from the hooks 25, allowing the cover to be removed from the spa and folded for storage.

The cap is lockable to the flange 61 by placing a pad lock through a pair of locking buckles 73 and 75, one attached to the cap 57 and the other attached to the flange 61. Because the cap cannot be removed without removing the pad lock, unauthorized use of the spa is prevented by preventing access to the deflating mechanism 55. Preferably, the plastic flange 61 and the cap 57 are designed such that a person attempting to remove the cap 57 must both squeeze and pull the cap 12 for it to rotate. Also, preferably, a full rotation (substantially 360°) is required before the cap can be removed.

The pressure release pipe 59 also serves as an easy access for maintaining the quality of the spa water without removing the cover. Water for testing pH and chlorine levels can be drawn without removing the cover, and water and chemicals can be added through the pressure release pipe 59. The proper water level can be judged by the tightness of the cover. A thermometer can be attached with a string to a ring 76 located inside the cap 57 and dropped into the spa water.

Because the large dead air space 37 covers as much of the water surface 33 as possible, the dead air space provides a significant amount of insulation. Insulation can be improved by adding an insulating liner 77 sandwiched between the outer sheet 13 of the cover 11 and an inner sheet 79. The added insulation provided by the insulating liner 77 prevents significant cooling of the dead air space 37, thereby preventing deflation of the cover due to a reduction of the dead air space temperature and a related decrease in dead air space pressure. For ease of manufacturing, preferably, the inside sheet 79 is attached to the outer sheet 13 of the cover 11 by airtight welds 31. The inside sheet 79 may be contiguous with skin 29, if desired. Preferably, the inner sheet and the skirt are formed of a suitable plastic material, such as vinyl.

If additional thermal insulation is desired, the cover may be used in conjunction with a traditional vapor barrier made of bubble plastic or a closed cell foam cover floating on the water surface 33. The floating cover must be cut slightly smaller than the water surface 33 of the spa to provide space for the skirt 29 and for air bubbles 47 to rise around the floating cover and enter the dead air space 37. Apertures for the flexible ventilation pipe 49 and the pressure release pipe 59 also must be provided. During installation, care must be taken to see that the skirt 29 drops below the water surface 33 and the vapor barrier and to see that the flexible ventilation pipe 49 and the pressure release pipe 59 are aligned with the apertures in the floating cover.

As shown in FIG. 4, the invention also includes a plate 81, preferably made of rigid plastic, for preventing the skirt 29 from obstructing water flow through the strainer 83 and the return pipe 85 to the pump of the spa. More specifically, many self-contained spas provide return water to the spa filtration system through a strainer 83 positioned at the water surface 33. Since the skirt 29 is flexible, it could close the opening into the strainer and thus prevent water from flowing through the return pipe 85 to the spa filtration system, resulting in improper operation of the filtration system. The invention avoids this problem by placing a plastic plate 81 slightly wider than the width of the input to the strainer 83, and deeper than the skirt 29 over the strainer input. Preferably, the plate is flat and attached to the inside of the spa edge 17 by suction cups 87. The suction cups hold the plate 81 away from the wall 17 by a distance adequate to allow water to flow between the plate 81 and the spa edge 17 into the strainer 83 and return pipe 85.

Figure 5:
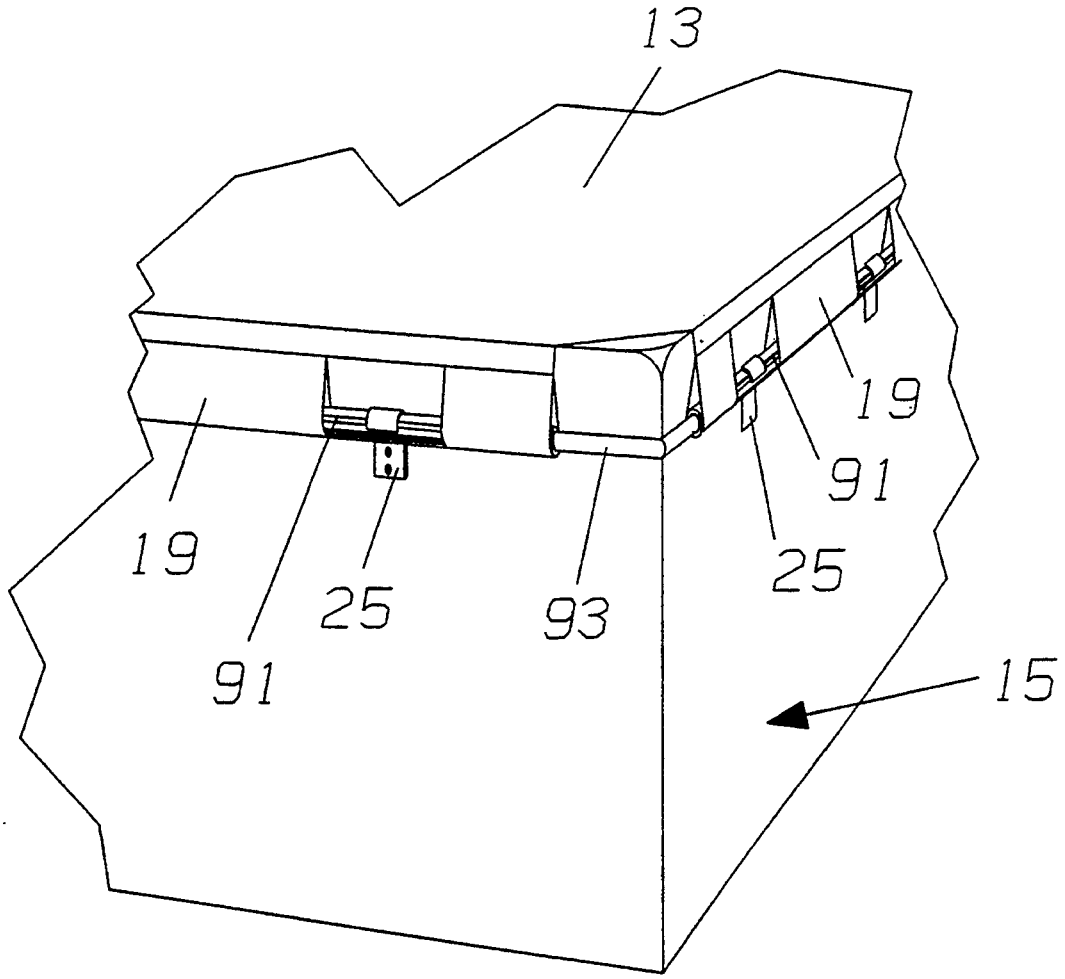
FIG. 5 is a view of a corner of an alternative embodiment of a spa cover formed in accordance with this invention.

FIG. 5 is a comer view illustrating a modification to the embodiment of the invention illustrated and described above. Specifically, rather than using solid fastener rods, the fastener rods 91 shown in FIG. 5 are hollow. Threaded through the hollow fastener rods 91 is a continuous bungee cord 93. Since bungee cord is stretchable, the bungee cord 93 stretches around the comers of a spa when the fastener rods are slipped under the hooks and keep the fastener rods firmly under the hooks until inflation pulls the fastener rods upwardly against the hooks.

Figure 6:
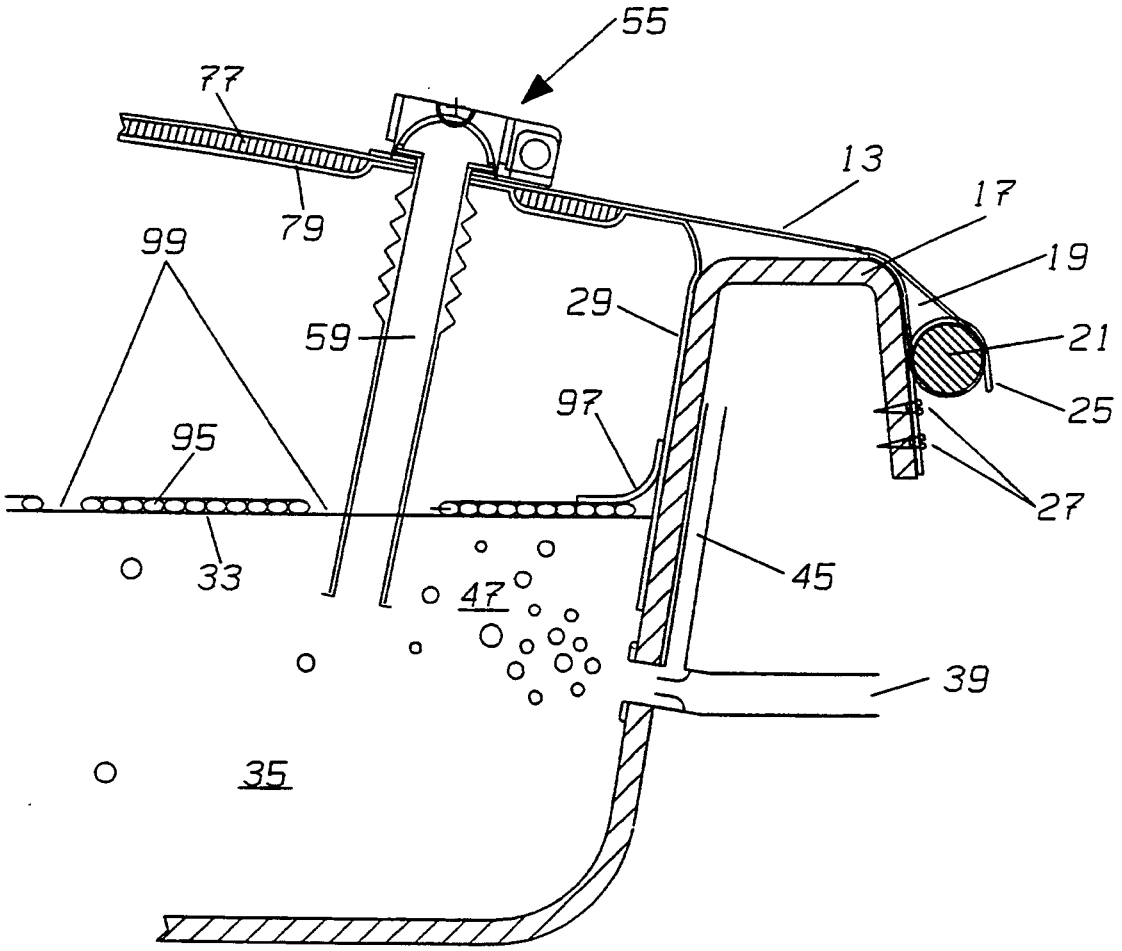
FIG. 6 is a partial cross-sectional view illustrating a further alternative embodiment of this invention.

FIG. 6 is a partial cross-sectional view of another modification to the embodiment of the invention illustrated in FIGS. 1–4 and described above. Specifically, FIG. 6 shows an additional surface evaporation barrier 95 floating on the surface 33 of the spa water 35. The surface evaporation barrier 95 may be formed of bubble plastic or closed cell foam. However, rather than being a separate item, the surface evaporation barrier 95 is attached to the inner surface of the skirt 29 by a suitable attachment straps 97, such as Velcro straps or hooks and loops. The surface evaporation barrier includes apertures for the air ventilation pipe 49 (not shown) and the pressure release pipe 59, plus additional apertures 99 to allow air to enter the dead air space 37. Coupling the surface evaporation barrier 95 to the skirts allows a single cover, rather than two covers, to be removed when access to the spa is desired.

While preferred embodiments of the invention have been illustrated and described, it will be appreciated that within the scope of the appended claims various changes can be made therein without departing from the spirit and scope of the invention.

The embodiments of the invention in which an exclusive property or privilege is claimed are defined as follows:

1. A self-inflating air tight cover for a spa comprising:

an outer sheet formed of an air impermeable material sized to cover a spa;

a skirt affixed to and hanging downwardly from said outer sheet when said outer sheet is positioned atop a spa filled with water, the vertical height of said skirt being such that the lower end of said skirt enters the water in said spa when said outer sheet is positioned atop a spa;

attachment means for attaching said outer sheet to a spa such that, once that outer sheet is attached to said spa and the lower end of said skin enters said spa water, a dead air space is created between said outer sheet and said spa water that traps air introduced into said spa water by the ventilation system that forms part of said spa, said trapped air causing said outer sheet to rise;

height control means for automatically releasing air from said dead air space when the trapped air in said dead air space causes said outer sheet to rise a predetermined distance above the level of the water in said spa regardless of the magnitude of the pressure of said trapped air in said dead air space; and manually actuable pressure release means for releasing trapped air from said dead air space.

2. A self-inflating airtight cover for a spa as claimed in claim 1 wherein said attachment means prevents said cover from being removed from said spa when said trapped air in said dead air space causes said outer sheet to rise said predetermined distance above the level of the water in said spa.

3. A self-inflating airtight cover as claimed in claim 2 wherein said attachment means comprises:

a plurality of pockets located about the periphery of said outer sheet;

a plurality of rods mounted in said plurality of pockets; and a plurality of inverted hooks attached to the outer surface of said spa for engaging said plurality of rods in between said plurality of pockets.

4. A self-inflating airtight cover for a spa as claimed in claim 2 wherein said height control means comprises an air ventilation pipe having an upper end attached to said outer sheet and a lower end that extends inwardly and lies substantially at the surface of said water in said spa when the trapped air in said dead air space causes said outer sheet to rise said predetermined distance above the level of the water in said spa.

5. A self-inflating airtight cover as claimed in claim 4 wherein said manually actuable pressure release means comprises a pressure release pipe and a closure means, said pressure release pipe having an upper end attached to said cover sheet, said closure means closing the upper end of said pressure release pipe.

6. A self-inflating airtight cover as claimed in claim 5 wherein the lower end of said pressure release pipe extends into said spa water when said trapped air in said dead air space causes said outer sheet to rise said predetermined distance above the level of the water in said spa and wherein said manually actuable pressure release means includes means for withdrawing said lower end of said pressure release pipe from said spa water.

7. A self-inflating airtight cover as claimed in claim 6 wherein said pressure release pipe includes a pair of telescoping sections, the outer section of said pair of telescoping sections being collapsible and the inner section of said pair of telescoping sections including a flange that impinges on and forces said outer section to collapse when said inner section is axially moved in one direction with respect to said outer section.

8. A self-inflating airtight cover as claimed in claim 7 including locking means for locking said closure means of said pressure release means to said outer sheet.

9. A self-inflating airtight cover as claimed in claim 5 including an insulation layer attached to the inner surface of said outer sheet.

10. A self-inflating airtight cover as claimed in claim 9 including an evaporation barrier attached to said skirt and positioned so as to lie atop said spa water.

11. A self-inflating airtight cover for a spa as claimed in claim 1 wherein said height control means comprises an air ventilation pipe having an upper end attached to said outer sheet and a lower end that extends inwardly and lies substantially at the surface of said water in said spa when the trapped air in said dead air space causes said outer sheet to rise said predetermined distance above the level of the water in said spa.

12. A self-inflating airtight cover as claimed in claim 11 wherein said manually actuable pressure release means comprises a pressure release pipe and a closure means, said pressure release pipe having an upper end attached to said cover sheet, said closure means closing the upper end of said pressure release pipe.

13. A self-inflating airtight cover as claimed in claim 12 wherein the lower end of said pressure release pipe extends into said spa water when said trapped air in said dead air space causes said outer sheet to rise said predetermined distance above the level of the water in said spa and wherein said manually actuable pressure release means includes means for withdrawing said lower end of said pressure release pipe from said water.

14. A self-inflating airtight cover as claimed in claim 13 wherein said pressure release pipe includes a pair of telescoping sections, the outer section of said pair of telescoping sections being collapsible and the inner section of said pair of telescoping sections including a flange that impinges on and forces said outer section to collapse when said inner section is axially moved in one direction with respect to said outer section.

15. A self-inflating airtight cover as claimed in claim 14 including locking means for locking said closure means of said pressure release means to said outer sheet.

16. A self-inflating airtight cover as claimed in claim 11 including an insulation layer attached to the inner surface of said outer sheet.

17. A self-inflating airtight cover as claimed in claim 16 including an evaporation barrier attached to said skirt and positioned so as to lie atop said spa water.

18. A self-inflating airtight cover as claimed in claim 1 wherein said manually actuable pressure release means comprises a pressure release pipe and a closure means, said pressure release pipe having an upper end attached to said cover sheet, said closure means closing the upper end of said pressure release pipe.

19. A self-inflating airtight cover as claimed in claim 18 wherein the lower end of said pressure release pipe extends into said spa water when said trapped air in said dead air space causes said outer sheet to rise said predetermined distance above the level of the water in said spa and wherein said manually actuable pressure release means includes means for withdrawing said lower end of said pressure release pipe from said spa water.

20. A self-inflating airtight cover as claimed in claim 19 wherein said pressure release pipe includes a pair of telescoping sections, the outer section of said pair of telescoping sections being collapsible and the inner section of said pair of telescoping sections including a flange that impinges on and forces said outer section to collapse when said inner section is axially moved in one direction with respect to said outer section.

21. A self-inflating airtight cover as claimed in claim 20 including locking means for locking said closure means of said pressure release means to said outer sheet.

22. A self-inflating airtight cover as claimed in claim 18 including an insulation layer attached to the inner surface of said outer sheet.

23. A self-inflating airtight cover as claimed in claim 22 including an evaporation barrier attached to said skirt and positioned so as to lie atop said spa water.

* * * * *

UNITED STATES PATENT AND TRADEMARK OFFICE

CERTIFICATE OF CORRECTION

PATENT NO. : 5,373,590

DATED : December 20, 1994

INVENTOR(S) : B. Svae et al.

It is certified that error appears in the above-indentified patent and that said Letters Patent is hereby corrected as shown below:

| COLUMN | LINE | |
|---|---|---|
| 1 | 27 | "time." should read --time,-- |
| 1 | 42 | "covers. i.e.." should read --covers, i.e.,-- |
| 6 | 10 | "comer" should read --corner-- |
| 6 | 58 | "skin" should read --skirt-- |

Signed and Sealed this

Twenty-first Day of March, 1995

*Attest:*

Bruce Lehman

BRUCE LEHMAN

*Attesting Officer*

*Commissioner of Patents and Trademarks*